US006089336A

United States Patent [19]

Nexton et al.

[11] Patent Number: 6,089,336

[45] Date of Patent: Jul. 18, 2000

[54] ROTARY DRILL BITS

[75] Inventors: Alex Nexton; Michael Tomczak, both of Houston, Tex.; Steven Taylor, Cheltenham, United Kingdom; Andrew Murdock, Stonehouse, United Kingdom; John M. Clegg, Bristol, United Kingdom

[73] Assignee: Camco International (UK) Limited, Stonehouse, United Kingdom

[21] Appl. No.: 08/834,439

[22] Filed: Apr. 16, 1997

Related U.S. Application Data

[63] Continuation-in-part of application No. 08/541,774, Oct. 10, 1995, Pat. No. 5,671,818.

[51] Int. Cl.[7] ..... E21B 10/60

[52] U.S. Cl. ..... 175/393; 175/399

[58] Field of Search ..... 175/393, 428, 175/399, 430, 431, 400, 417, 429

[56] References Cited

U.S. PATENT DOCUMENTS 5,145,017 9/1992 Holster et al. ..... 175/393

5,794,725 8/1998 Trujillo et al. ..... 175/339

*Primary Examiner*—Frank Tsay

*Attorney, Agent, or Firm*—Jeffery E. Daly

[57] ABSTRACT

A rotary drill bit for use in drilling holes in subsurface formations comprises a bit body having a leading face and a gauge region, a number of blades formed on the leading face of the bit and extending outwardly away from the axis of the bit so as to define between the blades a number of fluid channels leading towards the gauge region, a number of cutting elements mounted side-by-side along each blade, and a number of nozzles in the bit body for supplying drilling fluid to the fluid channels for cleaning and cooling the cutting elements. In each of the fluid channels, adjacent the gauge region, is an opening into an enclosed passage which passes internally through the bit body to an outlet which, in use, communicates with the annulus between the drill string and the wall of the borehole being drilled. The gauge region of the drill bit comprises a substantially continuous bearing surface which extends around the whole of the gauge region.

51 Claims, 7 Drawing Sheets

FIG 8
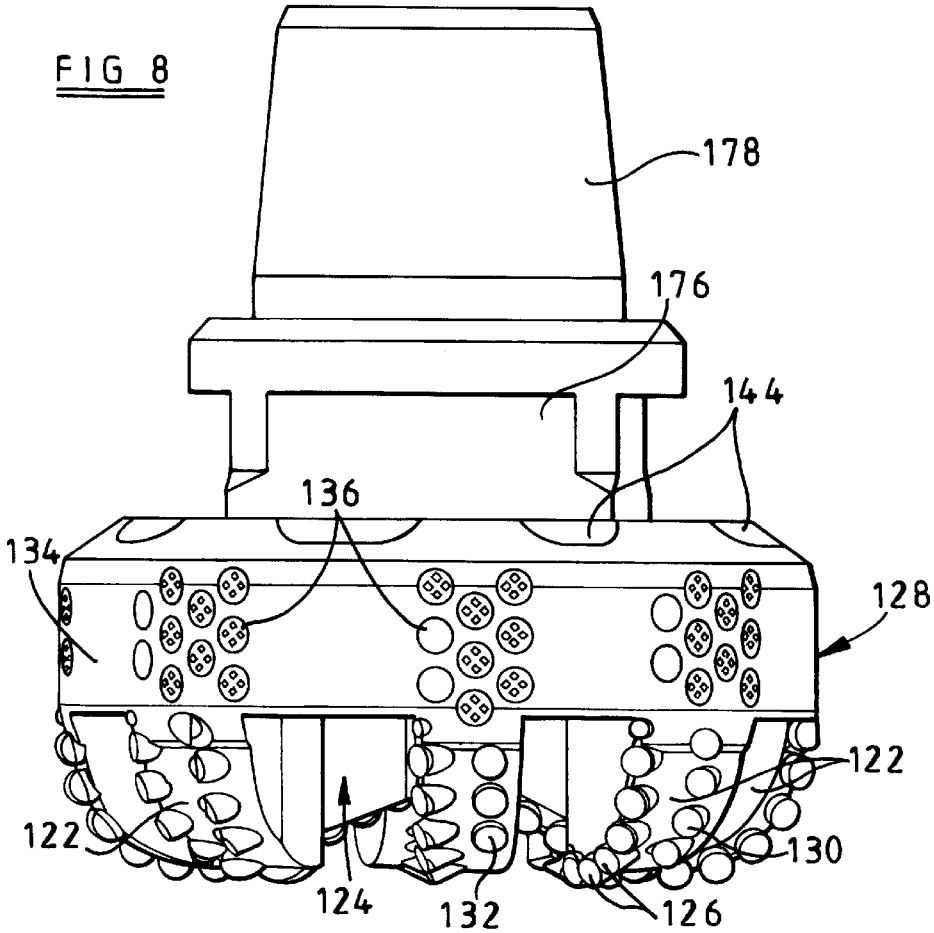
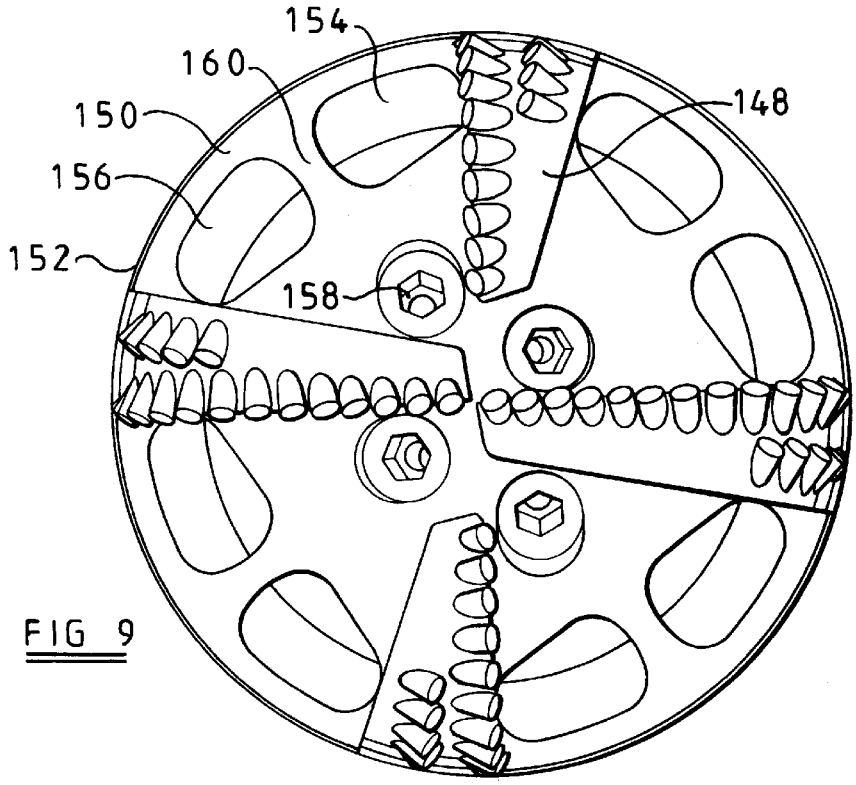
FIG 9

ROTARY DRILL BITS

REFERENCE TO RELATED APPLICATION

This is a Continuation-in-Part of U.S. patent application Ser. No. 08/541,774, filed Oct. 10, 1995. And now is U.S. Pat. No. 5,671,818. Also, this application is related to another continuation-in-part application of the same parent application and having the same title by Douglas Caraway, John Hayward, Malcolm R. Taylor, Tom Scott Roberts, Steven Taylor, and Graham Watson filed simultaneously with the present application, the entirety of which is hereby incorporated by reference.

BACKGROUND OF THE INVENTION

1. Field of the Invention

The invention relates generally to rotary drill bits and, more particularly, to rotary drill bits for use in drilling holes in subsurface formations.

2. Description of the Related Art

In the normal prior art construction, the gauge region of a drill bit is formed by a plurality of kickers which are spaced apart around the outer periphery of the bit body and are formed with bearing surfaces which, in use, bear against the wall of the borehole. The kickers generally form continuations of respective blades formed on the leading face of the bit and extending outwardly away from the axis of the bit towards the gauge region so as to define between the blades fluid channels leading towards the gauge region. The spaces between the kickers define junk slots with which the channels between the blades communicate. During drilling, drilling fluid pumped down the drill string to nozzles in the bit body flows outwardly along the channels, into the junk slots at the end of the channels, and passes upwardly through the junk slots into the annulus between the drill string and the wall of the borehole.

While such PDC bits have been very successful in drilling relatively soft formations, they have been less successful in drilling harder formations, including soft formations which include harder occlusions or stringers. Although good rates of penetration are possible in harder formations, the PDC cutters may suffer accelerated wear. Thus, bit life may be too short to be commercially acceptable.

Studies have suggested that the rapid wear of PCD of bits in harder formations may be due to chipping of the cutters as a result of impact leads caused by vibration of the drill bit. One of the most harmful types of vibration can be attributed to a phenomenon called "bit whirl," in which the drill bit begins to precess around the hole in the opposite direction to the direction of rotation of the drill bit. One result of bit whirl is that some cutters may temporarily move in the reverse direction relative to the formation and this can result in damage to the cutting elements.

It is believed that the stability of such a drill bit, and its ability to resist vibration, may be enhanced by increasing the area of the bearing surfaces on the gauge region which engage the wall of the borehole. In the prior art designs, however, the area of engagement can only be increased by increasing the length and/or width of the bearing surfaces on the kickers. It may be undesirable to increase the length of the bearing surfaces since this may lead to difficulties in steering the bit in steerable drilling systems. Similarly, increasing the circumferential width of the bearing surfaces necessarily reduces the width of the junk slots between the bearing surfaces, and this may lead to less than optimum hydraulic flow of drilling fluid along the channels and over the cutters, or it may lead to blockage of the junk slots and channels by debris.

The present invention is directed to overcoming, or at least reducing the affects of, one or more of the problems mentioned above. Specifically, the present invention may provide a rotary drill bit where the bearing surface area of the gauge region of the drill bit may be increased without the above-mentioned disadvantages, and which may also give rise to other advantages. Also, the present invention may provide a non-aggressive smooth steerable drill bit for applications where high directional control is required.

SUMMARY OF THE INVENTION

In accordance with one aspect of the present invention, there is provided a rotary drill bit for connection to a drill string and for drilling boreholes in subsurface formations. The drill bit includes a bit body having a leading face and a gauge region, a plurality of cutting elements mounted on the leading face of the bit body, a plurality of fluid channels formed in the leading face of the bit body and extending outwardly away from the axis of the bit towards the gauge region, and a plurality of nozzles mounted in the bit body for supplying drilling fluid to the channels for cleaning and cooling the cutting elements. There is provided in at least one of the channels an opening into an enclosed passage which passes internally through the bit body to an outlet which, in use, communicates with the annulus between the drill string and the wall of the borehole being drilled. The portion of the gauge region outwardly of the opening includes a bearing surface which extends across the width of the one channel and, in use, bears against the wall of the borehole.

In accordance with another aspect of the present invention, there is provided a rotary drill bit for connection to a drill string and for drilling boreholes in subsurface formations. The drill bit includes a bit body having a leading face and a gauge region, a plurality of cutting elements mounted on the leading face of the bit body, a plurality of fluid channels formed in the leading face of the bit body, and a plurality of nozzles mounted in the bit body for supplying drilling fluid to the channels for cleaning and cooling the cutting elements. There is provided in at least one of the channels an opening into an enclosed passage which passes internally through the bit body to an outlet which, in use, communicates with the annulus between the drill string and the wall of the borehole being drilled. The gauge region of the drill bit includes a bearing surface which extends around substantially the whole of the gauge region. The gauge region bearing surface may be substantially continuous.

In accordance with still another aspect of the present invention, there is provided a rotary drill bit for connection to a drill string and for drilling boreholes in subsurface formations comprising a bit body having a leading face and a gauge region, a plurality of blades formed on the leading face of the bit and extending outwardly away from the axis of the bit towards the gauge region so as to define between the blades a plurality of fluid channels leading towards the gauge region, a plurality of cutting elements mounted along each blade, and a plurality of nozzles mounted in the bit body for supplying drilling fluid to the channels for cleaning and cooling the cutting elements. There is provided in at least one of the channels an opening into an enclosed passage which passes internally through the bit body to an outlet which, in use, communicates with the annulus between the drill string and the wall of the borehole being drilled. The gauge region of the drill bit includes a substantially continuous bearing surface which extends around substantially the whole of the gauge region.

In accordance with yet another aspect of the present invention, there is provided a rotary drill bit for drilling a borehole. The drill bit includes a bit body having a leading face and a peripheral gauge region. A shank is coupled to the body. The shank has at least one relieved portion. An opening is disposed in the leading face. The opening leads to a passage passing internally through the bit body between the opening and an outlet. A bearing surface is disposed at a portion of the gauge region radially outwardly from the opening.

In accordance with a flurther aspect of the present invention, there is provided a rotary drill bit for drilling a borehole. The drill bit includes a bit body having a leading face and a peripheral gauge region. A plurality of blades is disposed on the leading face. The plurality of blades extend outwardly toward the gauge region and form a plurality of fluid channels therebetween. A plurality of cutting elements is disposed on each of the plurality of blades. A plurality of nozzles is disposed in the bit body for supplying fluid to each of the fluid channels. A substantially continuous bearing member is disposed in actually spaced apart relation to the bit body. A plurality of fluid passageways passes through an interior portion of the bearing member for receiving the fluid.

In accordance with an even further aspect of the present invention, there is provided a rotary drill bit. The drill bit includes a bit body having a leading face and a peripheral gauge region. An opening is disposed in the leading face. The opening leads to a passage passing internally through the bit body between the opening and an outlet. A bearing surface is disposed at a portion of the gauge region outwardly from the opening. A plurality of reaming cutters is disposed on the gauge region and spaced apart from the reading face.

In accordance with a still further aspect of the present invention, there is provided a rotary drill bit. The drill bit includes a bit body having a leading face and a peripheral gauge region. An opening is disposed in the leading face. The opening leads to a passage passing internally through the bit body between the opening and an outlet. A bearing surface is disposed at a portion of the gauge region outwardly from the opening. A peripheral chamfered edge is formed in the gauge region and is spaced apart from the leading face.

In accordance with a yet flurther aspect of the present invention, there is provided a rotary drill bit. The drill bit includes a bit body having a leading face and a peripheral gauge region. A plurality of blades is disposed on the leading face. The plurality of blades extends outwardly toward the gauge region and forms a plurality of fluid channels therebetween. An opening is disposed in at least one of the plurality of fluid channels. The opening leads to a passage passing internally through the bit body between the opening and an outlet. At least one of the plurality of fluid channels terminates in a bearing member that is disposed at a portion of the gauge region outwardly from the opening. A junk slot terminates at least another of the plurality of fluid channels.

In accordance with another aspect of the present invention, there is provided a rotary drill bit. The drill bit includes a bit body having a leading face and a peripheral gauge region. A plurality of cutting elements is disposed on the leading face. A first plurality of fluid channels is formed in the leading face. A second plurality of fluid channels is formed in the leading face. A respective opening is disposed in each of the first plurality of fluid channels. Each of the respective openings leads to a respective passage passing internally through the bit body. A respective bearing member is disposed at a portion of the gauge region outwardly from each of the respective openings. A respective junk slot terminates each of the second plurality of fluid channels.

In accordance with still another aspect of the present invention, there is provided a rotary drill bit. The drill bit includes a bit body having a leading face and a peripheral gauge region. A plurality of cutting elements is disposed on the leading face. A plurality of fluid channels is formed in the leading face. A plurality of nozzles is disposed in the bit body for supplying fluid to the plurality of channels. A respective opening is disposed in each circumferentially alternate fluid channel. Each of the respective openings leads to a respective passage passing internally through the bit body. A respective bearing member is disposed at a portion of the gauge region outwardly from each of the respective openings. A respective junk slot terminates each fluid channel having no opening.

In accordance with yet another aspect of the present invention, there is provided a method of drilling a borehole. The method includes the steps of:

(a) rotating a drill bit within a formation, the drill bit having cutting elements thereon;

(b) passing fluid through the drill bit to at least a portion of the cutting elements; and (c) routing fluid from the portion of the cutting elements internally through the drill bit to an annulus between the drill bit and the borehole.

In accordance with further aspect of the present invention, there is provided a method of steering a drill bit within a borehole. The method includes the steps of:

(a) rotating a drill bit within the borehole, the drill bit having a peripheral gauge region and having a substantially continuous bearing surface disposed about the peripheral gauge region; and (b) applying a force to the substantially continuous bearing surface to cause the drill bit to change direction of drilling the borehole.

BRIEF DESCRIPTION OF THE DRAWINGS

The foregoing and other advantages of the invention may become apparent upon reading the following detailed description and upon reference to the drawings in which:

FIG. 8 is a side elevation of the drill bit of FIG. 6;

FIG. 9 is an end view of yet another embodiment of a drill bit in accordance with the present invention;

DETAILED DESCRIPTION OF SPECIFIC EMBODIMENTS

Figure 1:
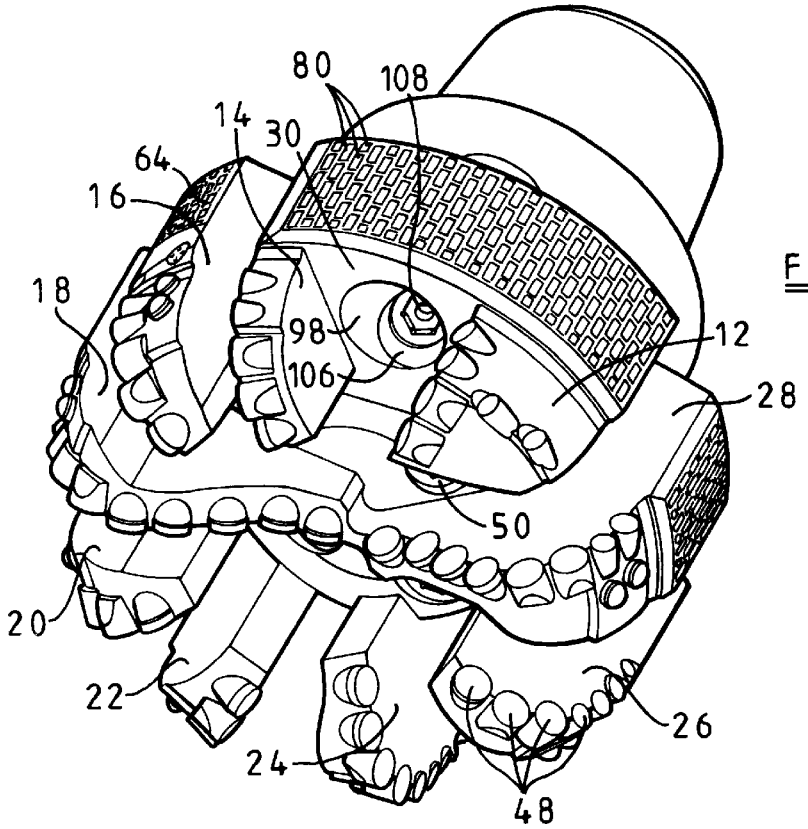
FIG. 1 is a perspective view of one embodiment of a drill bit in accordance with the invention.
Figure 2:
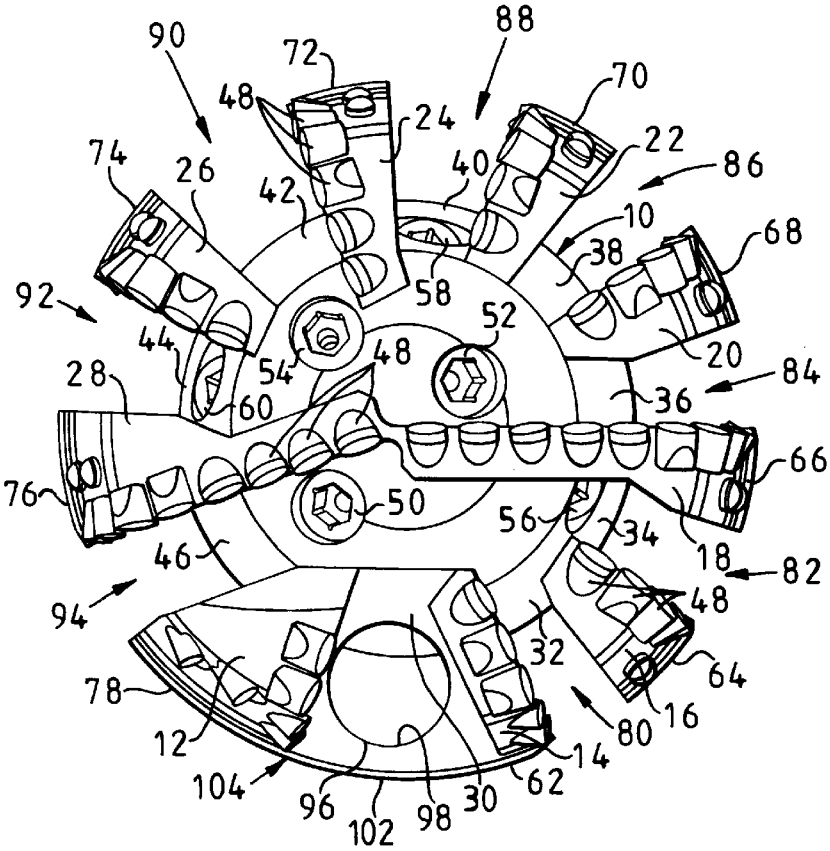
FIG. 2 is an end view of the drill bit shown in FIG. 1.
Figure 3:
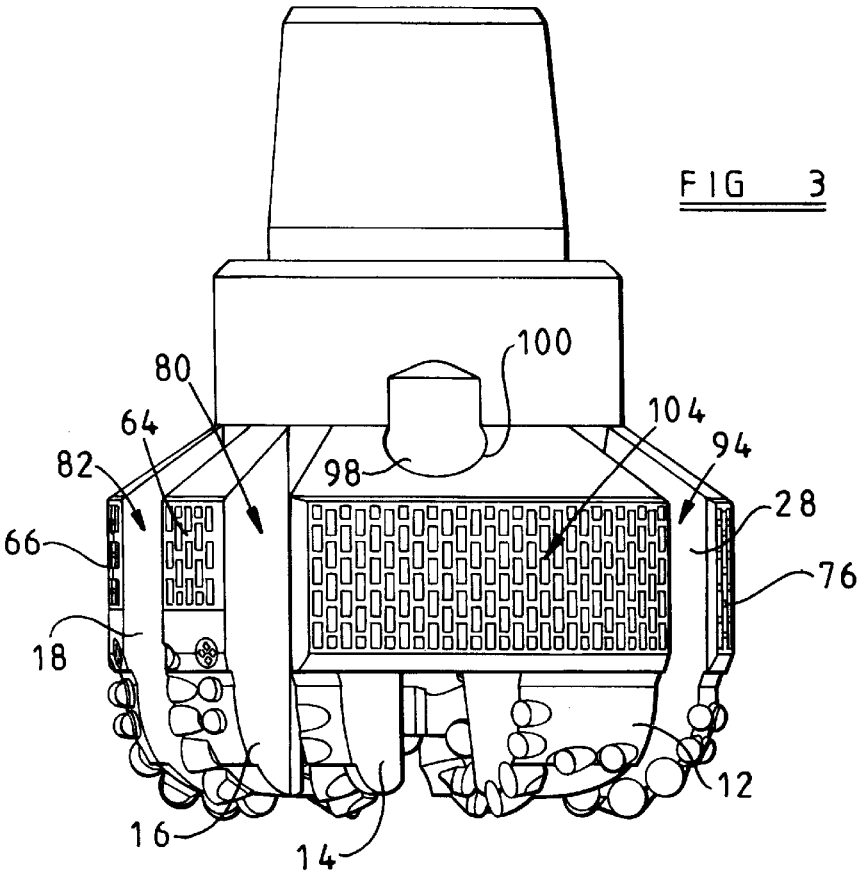
FIG. 3 is a side elevation of the drill bit.

Turning to the drawings, and referring initially to FIGS. 1–4, the drill bit includes a bit body 10 and nine blades 12, 14, 16, 18, 20, 22, 24, 26, and 28 formed on the leading face of the bit and extending outwardly from the axis of the bit body 10 towards to a gauge region 29. Between adjacent blades there are defined channels 30, 32, 34, 36, 38, 40, 42, 44, and 46.

Extending side-by-side along each of the blades are a plurality of cutting elements or structures 48. The precise nature of the cutting structures 48 does not form a part of the present invention, so they may be of any appropriate type. For example, as shown, they may be circular preformed cutting elements brazed to cylindrical carriers which are embedded or otherwise mounted in the blades. The cutting elements each may include a pre-formed compact having a polycrystalline diamond front cutting layer bonded to a tungsten carbide substrate, the compact being brazed to a cylindrical tungsten carbide carrier. In another form, the cutting structure 48 may include the substrate of the pre-formed compact being of sufficient axial length to be mounted directly in the blade, so that the additional carrier may then be omitted. Back-up abrasion elements or cutters 49 may be spaced rearwardly of some of the cutting structures, as shown.

Inner nozzles 50, 52, and 54 are mounted in the surface of the bit body 10 and are located fairly close to the central axis of rotation of the bit. Each inner nozzle 50, 52, and 54 is so located that it can deliver drilling fluid to two or more channels. In addition, peripheral nozzles 56, 58, and 60 are located in the channels 34, 40, and 44, respectively, and are oriented to direct drilling fluid inwardly along their respective channels towards the center of the drill bit. All of the nozzles communicate with a central axial passage (not shown) in the shank of the bit, to which drilling fluid is supplied under pressure downwardly through the drill string in known manner.

The outer extremities of the blades 12, 14, 16, 18, 20, 22, 24, 26, and 28 are formed with axially extending kickers 62, 64, 66, 68, 70, 72, 74, 76, and 78, respectively, which provide part-cylindrical bearing surfaces 79 which, in use, bear against the surrounding wall of the borehole and stabilize the bit in the borehole. Abrasion-resistant bearing elements 81, of any suitable known form, may be embedded in the bearing surfaces 79.

Each of the channels 32, 34, 36, 38, 40, 41, 44, and 46 leads to a respective junk slot 80, 82, 84, 86, 88, 90, 92, and 94. The junk slots extend upwardly between the kickers, generally parallel to the central longitudinal axis of the drill bit, so that drilling fluid flowing outwardly along each channel passes into the associated junk slot and flows upwardly, between the bit body and the surrounding formation, into the annulus between the drill string and the wall of the borehole.

However, the channel 30 between the blades 12 and 14 does not lead to a conventional junk slot, but continues right up to the gauge region 79 of the drill bit. Formed in the channel 30 adjacent the gauge region 79 is a circular opening 96 into an enclosed cylindrical passage 98 which extends through the bit body 10 to an outlet 100 (see FIG. 3) which communicates with the annulus. The kickers 78 and 62 at the outer extremities of the blades 12 and 14 are connected by an intermediate bearing member 101 that has a bearing surface 102 which extends across the width of the channel 30 so as to form, with the kickers 78 and 62, a large continuous part-cylindrical bearing surface 104.

As best seen in FIG. 1, a cylindrical socket 106 is formed in the side wall of the passage 98 and is included at an angle to the longitudinal axis of the passage 98. A nozzle 108 is mounted in the socket 106 and is angled to direct drilling fluid along the passage 98 towards the opening 96, so that the drilling fluid emerges from the opening 96 and flows inwardly along the channel 30.

Thus, in the case of the channel 30, the conventional junk slot is replaced by the enclosed passage 98 which passes internally through the bit body 10. This enables the provision on the adjacent part of the gauge region 29 of a bearing surface 104 of extended peripheral extent. This increased bearing surface 104 may enhance the stability of the drill bit in the borehole.

Figure 4:
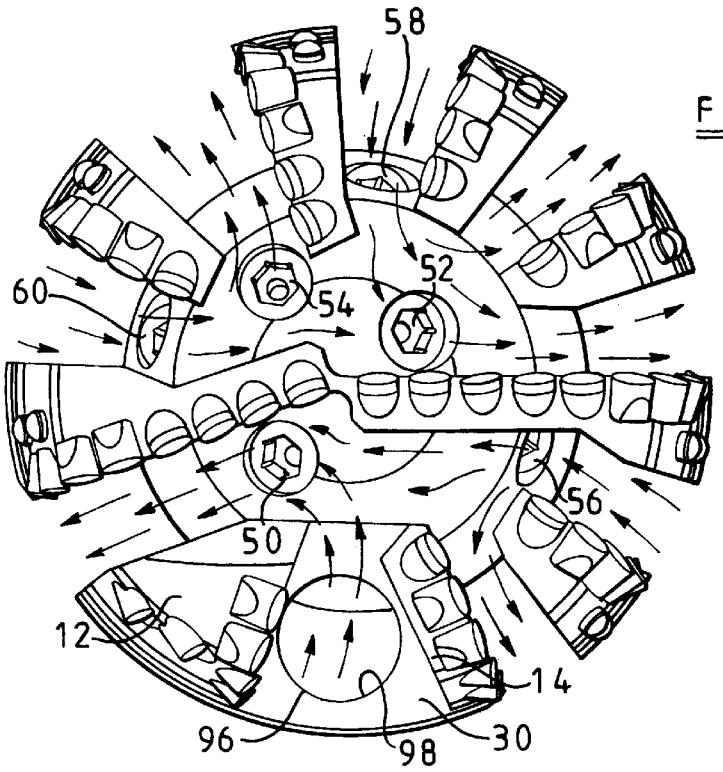
FIG. 4 is a similar view to FIG. 2 showing diagrammatically the hydraulic flow over the surface of the drill bit.

FIG. 4 shows diagrammatically a typical pattern of flow of drilling fluid over the face of the bit. It will be seen that drilling fluid flows inwardly, as indicated by the arrows, from the peripheral nozzles 108, 56, 58, and 60 towards the center of the bit and then across the face of the bit to flow outwardly along other channels. The outward flow is reinforced by the flow from the inner nozzles 50, 52, and 54.

However, other flow patterns are possible and may be achieved by appropriate location and orientation of the nozzles. For example, the nozzle 108 in the passage 98 may be oriented so as to direct a flow of drilling fluid upwardly through the passage 98 towards the outlet 100, in which case the flow along the channel 30 will be in an outward direction towards the opening 96. Alternatively, the nozzle 108 may be omitted altogether, and in this case also drilling fluid will flow outwardly along the channel 30, such flow being derived, for example, from the nozzles 50 and 56.

Figure 5:
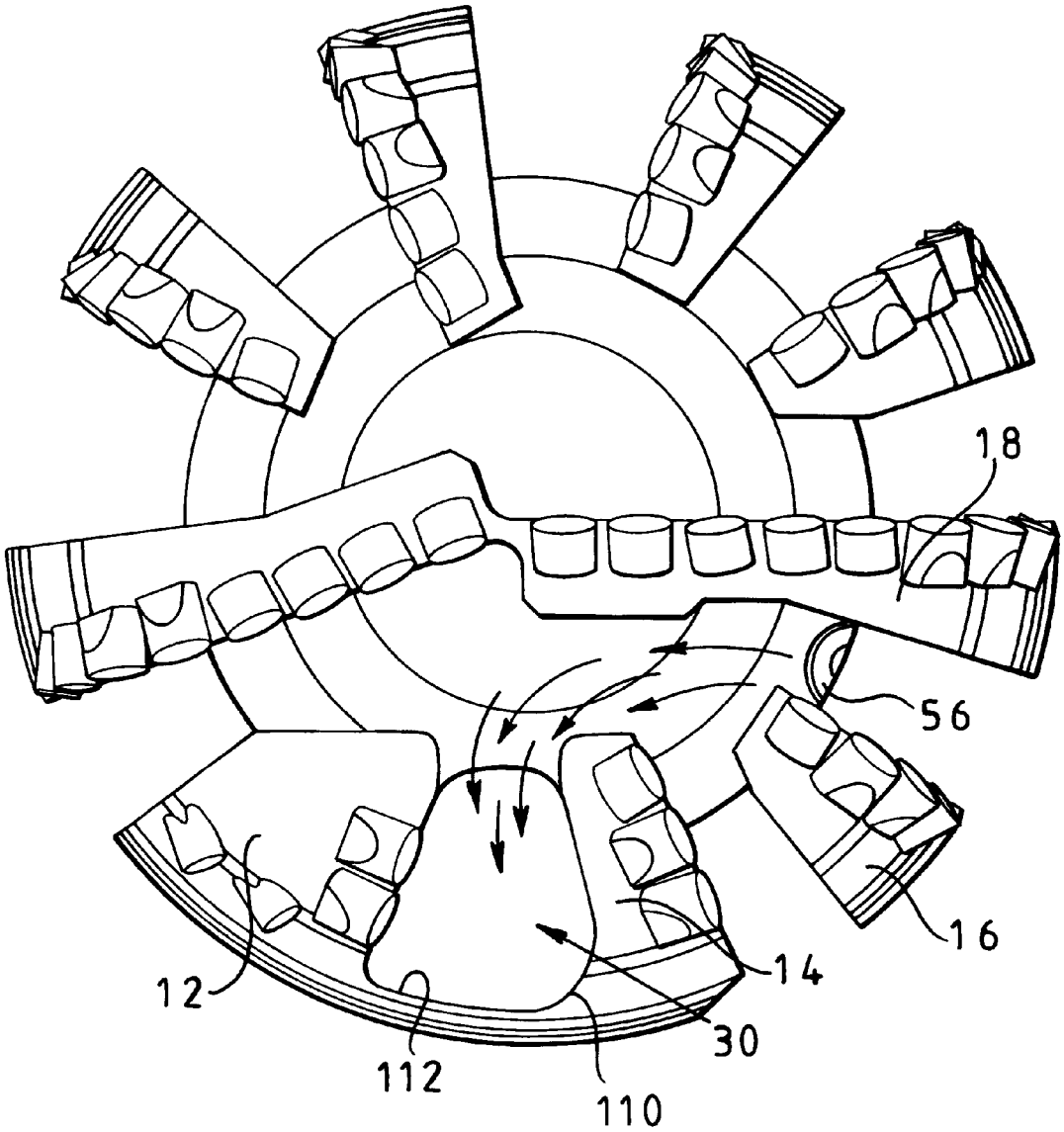
FIG. 5 is a similar view to FIG. 2 of an alternative form of drill bit.

FIG. 5 shows an alternative arrangement where the opening 110 into the passage 112 is irregularly shaped so as to extend over almost all of the entire area of the channel 30 between the blades 12 and 14. In this case, a nozzle is not provided in the passage 112 and the flow of drilling fluid along the channel 30 and through the passage 112 is derived from the peripheral nozzle 56, as indicated by the arrows in FIG. 5.

FIGS. 1 through 5 illustrate an enclosed passage in only one of the channels. However, an enclosed passage may be included in two or more of the channels. In other words, the drill bit may be arranged such that two or more of the channels are closed at their outer extremity by a bearing surface in the gauge region, rather than leading to conventional open junk slots. In each of the closed channels there is provided an enclosed passage, similar to the passage 98, which passes through the bit body. It will be appreciated that for each channel that is constructed in this manner, the overall bearing surface of the gauge region will be increased. In some cases, it may be desirable to replace all of the junk slots by enclosed passages, similar to the passage 98, such that the whole of the gauge region of the drill bit will comprise a substantially continuous and uninterrupted 360° bearing surface for engaging the wall of the borehole.

Figure 6:
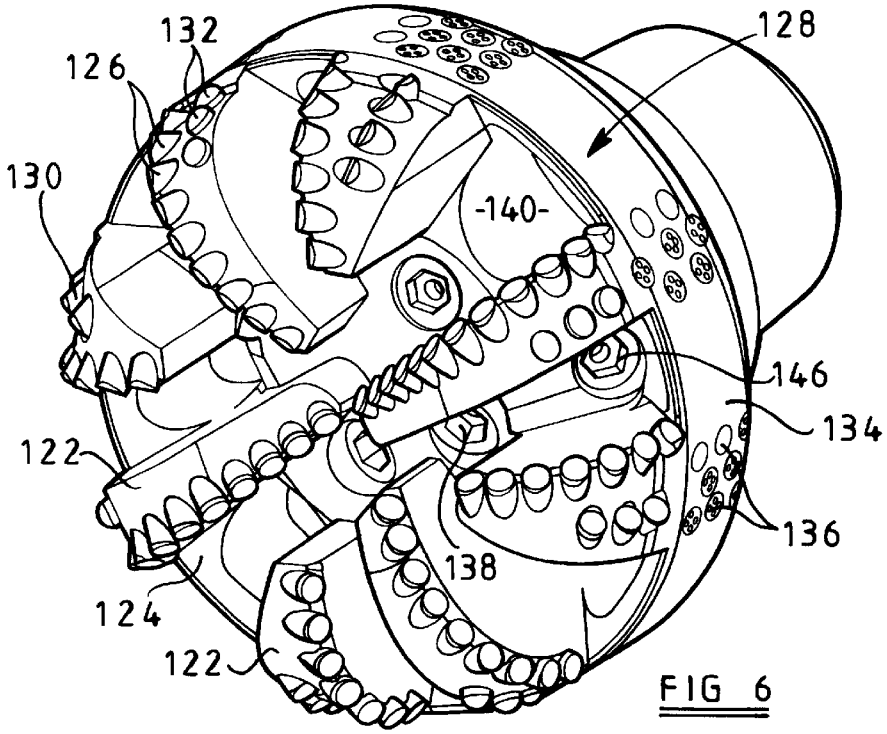
FIG. 6 is a perspective view of another embodiment of a drill bit in accordance with the present invention.
Figure 7:
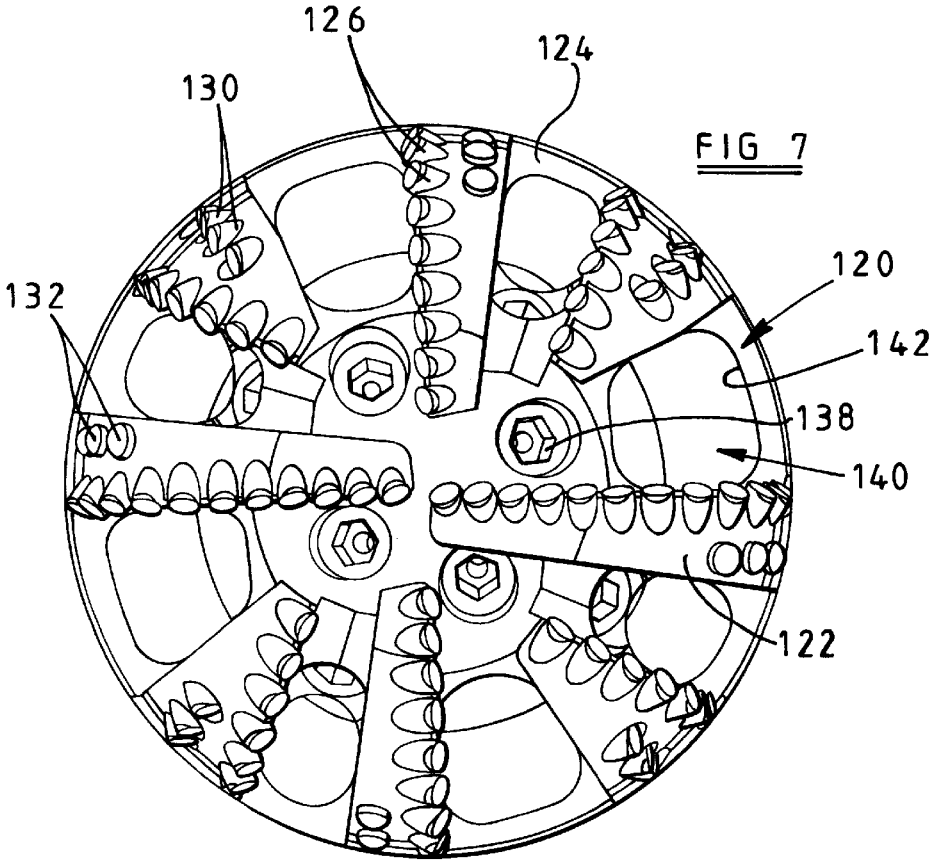
FIG. 7 is an end view of the drill bit shown in FIG. 6.

One such bit having a substantially continuous bearing surface extending around substantially the whole of the gauge region is illustrated in FIGS. 6–8. Similar to the drill bit illustrated in FIGS. 1–5, the drill bit includes a bit body 120 and eight blades 122 formed on the leading face of he bit and extending outwardly from the axis of the bit body towards the gauge region. Between adjacent blades 122 there are define channels 124.

Extending side-by-side along each of the blades 122 is a plurality of cutting structures 126. Each cutting structure 126 includes a preformed cutting element brazed to a cylindrical carrier which is embedded or otherwise mounted in one of the blades 122. Each cutting element may include a preformed compact having a polycrystalline diamond front cutting table which is bonded, by brazing for instance, to a tungsten carbide substrate. Alternatively, the substrate of the preformed compact may be of sufficient axially length to be mounted directly in the blade, so that the additional carrier may then be omitted. The cutting elements are set with a high back rake of 25 on the nose of the drill bit increasing to 40 on the shoulder adjacent the gauge section to reduce the reactive torque.

The outer region of the drill bit also has increased protection provided by the addition of back-up cutters 130 or abrasion elements 132 disposed rearwardly of the outer three or four cutters on each blade. The back-up cutters 130 may have the same exposure as the primary cutters 126, i.e., they may project to the same distance from the surface of the blade on which they are mounted. Alternatively, they may have a higher or a lower exposure. Similarly, the back rake of the back-up cutters 130 may be the same as the primary cutters 126, or they may have a greater or smaller back rake angle.

The location of the back-up cutters 130 may vary. For instance, each back-up cutter 130 may be located at the same radial position as a corresponding primary cutter 126 so as to follow the groove in the formation cut by its associated primary cutter 126. Alternatively, the back-up cutters 130 may be located at radial positions which are intermediate the radial positions of the associated primary cutters, so that each back-up cutter 130 removes from the formation the upstanding kerf left between the two grooves cut by adjacent primary cutters and, thus, provides a smoother surface to the borehole. Furthermore, each back-up cutter 130 may be located on the same blade as its associated primary cutter 126, or it may be on a different blade.

The gauge region 128 of the bit body includes a continuous bearing surface 134 which extends around the whole of the gauge region. Gauge protection is provided by inserts 136 which may be a mixture of polycrystalline diamond compacts and diamond inserts. Alternatively, the inserts may be made of tungsten carbide.

As may be seen from FIGS. 6 and 8, the gauge inserts 136 may be located on those parts of the bearing surface 134 which are located at the outer ends of the blades 122, i.e., in areas where the gauge region 29 is fully supported by the bit body 10 radially inwardly of the gauge region 29. The gauge inserts 136 act on the formation more aggressively than the intermediate portions of the bearing surface 134 where no inserts are provided. These greater forces are more easily accommodated by the full support of the inserts 136 by the bit body 10, as compared with the relatively unsupported portions of the bearing surface 134 adjacent the openings 140.

Inner nozzles 138 are mounted in the surface of the bit body and are located fairly close to the central axis of rotation of the bit. The inner nozzles 138 are positioned to give efficient cleaning in the central region of the bit and are also directed to deliver drilling fluid along a channel 124 on the leading side of one of the four longer blades 122 on the bit body, so as to clean and cool the cutting elements 126 mounted on that blade.

The channels 124 between the blades 122 do not lead to conventional junk slots which extend upwardly through the gauge region 128. Rather, the channels 124 continue right up to the continuous bearing surface 134 of the gauge region 128. A shaped opening 140 is formed in each channel 124 adjacent the gauge region 128. The opening 140 leads to an enclosed passage 142 which extends through the bit body 120 to an outlet 144, as illustrated in FIG. 8. The passage 142 communicates, in use, with the annulus between the drill string and the surrounding formation forming the walls of the borehole.

As best seen in FIGS. 7 and 8, outer nozzles 146 are located in those passages 142 which are disposed on the leading sides of the shorter blades 122. These four outer nozzles 146 are directed to the outer shoulder of the drill bit where a higher proportion of hydraulic energy is required to clean the increased cutter count in this region provided by the back-up cutters 130. Fluid flow from the inner nozzles 138 creates a pressure difference such that fluid from the outer nozzles 146 also flows inwardly towards the inner nozzles 138, across the inner cutters on the shorter blades, before flowing outwardly again with the outward flow from the inner cutters 138. Flow from both the inner nozzles 138 and outer nozzles 146 flows to the annulus through the openings 140 and passages 142 through the bit body. All of the nozzles 138 and 146 communicate with a central axial passage (not shown) in the shank of the bit, to which drilling fluid is supplied under pressure downwardly through the drill string in known manner.

The provision of a continuous bearing surface 134 around the whole of the gauge region of the drill bit substantially enhances the stability of the bit in operation. It reduces the bit's susceptibility to vibration, due to the absence of edges, cutting elements or other protrusions in the gauge region which otherwise might act on the surrounding formation to cause vibration and, under some circumstances, to initiate "bit whirl."

Furthermore, the provision of a continuous bearing surface around the whole periphery of the drill bit allows the axial length of the gauge section to be reduced while maintaining a suitable overall area of the bearing surface. As may be seen from FIG. 8, the gauge length of the drill bit is considerably less than is normally the case with a conventional PDC drill bit. For instance, a conventional 12.25 inch drill bit will normally have a gauge of 3 to 4 inches in axial length and will normally have an overall length of 12 to 16 inches. In contrast, a 12 inch drill bit of the kind shown in FIGS. 6–8 may have a gauge of only 2 inches in axial length and an overall bit length of only 9 inches, thereby not only reducing the axial length of the gauge section but also reducing the distance from the motor to the bit, in a steerable motor-driven system, and thereby improving the directional response of the drill bit when steering is taking place.

Although the passage 98 is described as being a cylindrical passage parallel to the longitudinal axis of the drill bit, other arrangements are possible. For example, the passage may vary in cross-sectional shape and/or diameter along its length. Two or more openings may be provided in the channel, the openings leading to separate passages through the bit body, or two or more openings may lead into a single passage.

In the arrangement shown in FIGS. 6–8, where the bit is provided with eight blades, there is provided a single opening 140 in each channel 124. However, when drilling some types of formation, particularly softer formations, it may be preferred to use a lighter set drill bit having fewer blades and cutters, since this may reduce the problem of bit balling. FIG. 9 shows such a lighter set drill bit, according to the invention, where only four blades 148 are provided, separated by channels 150 which are almost 90° in angular extent.

In such a construction, the provision of a single large opening and passage in the bit body, in order to deliver drilling fluid from each channel 150 past the continuous gauge section 152 to the annulus, may result in substantial structural weakening of the drill bit and, in particular, the gauge section. According to the arrangement shown in FIG. 9, therefore, each channel is formed with two openings 154 and 156 which communicate with separate passages leading through the bit body to the annulus. The larger of the two openings 154 is disposed adjacent the gauge section 152 and on the leading side of a respective blade 148, and the smaller opening 156 is disposed adjacent the trailing side of the preceding blade. In this case the inner nozzles 158 direct drilling fluid outwardly along the leading edges of the blades 148 respectively. The portion 160 of the bit body between each pair of openings 154, 156 may thus be regarded as a support strut which provides radial strength to the gauge section 152 between the widely angularly spaced blades 148.

Figure 10:
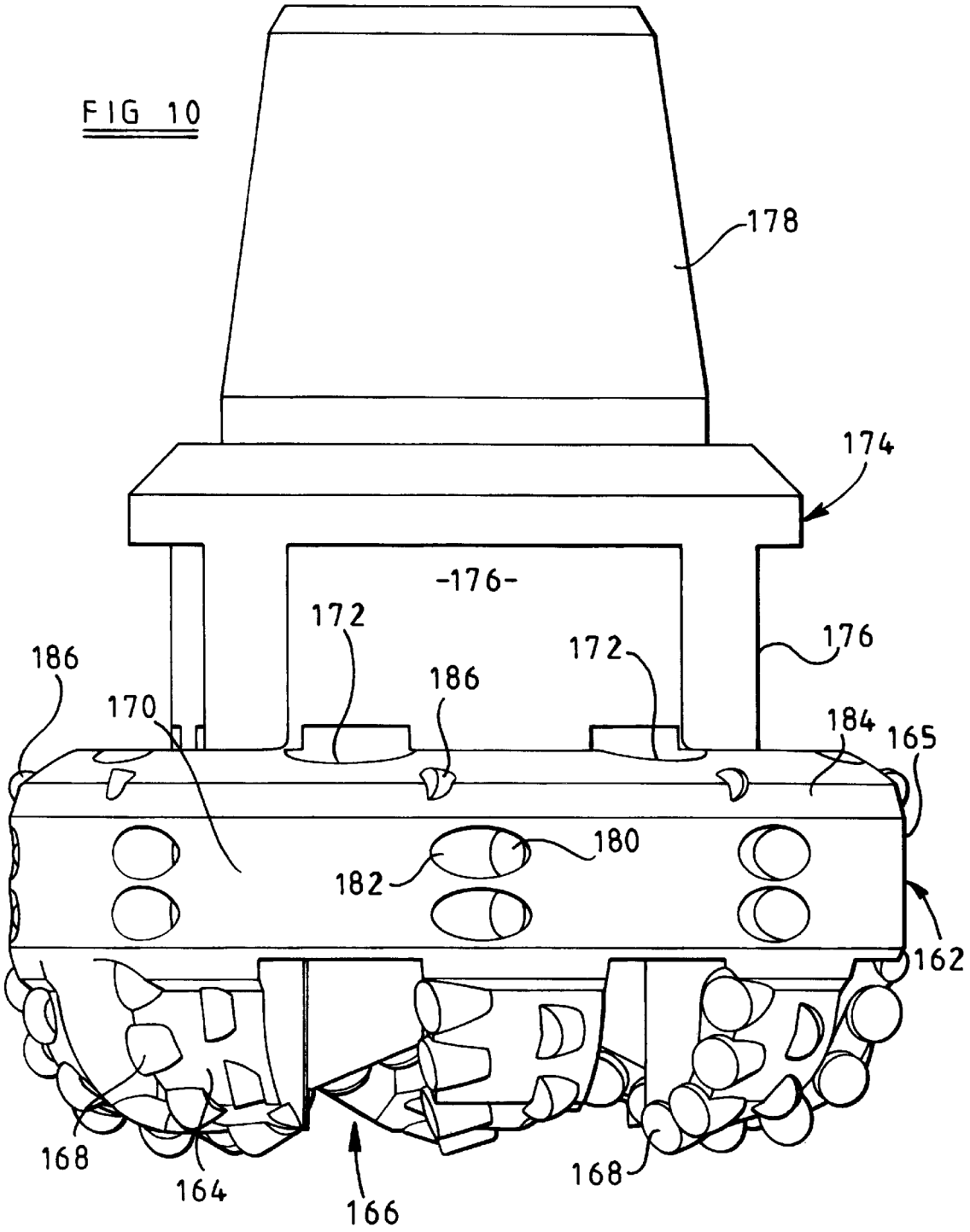
FIG. 10 is a side elevation of another embodiment of a drill bit in accordance with the invention.

Another embodiment of a drill bit is illustrated in FIG. 10. This drill bit includes a bit body 162. Eight blades 164 are formed on the leading face of the bit. These blades 164 extend generally outwardly from the central axis of the bit body 162 towards a gauge region 165 and, thus, define channels 166 therebetween. A plurality of cutting structures 168, which may be similar to the cutting structures described in reference to previous embodiments, extend side-by-side along each of the blades 164.

The gauge region 165 of the bit body 162 includes a continuous bearing surface that extends continuously around the whole of the gauge region 165. In similar fashion to the previously described embodiments, inner nozzles (not shown) may be mounted in the surface of the bit body, close to the central axis of rotation for instance, to deliver drilling fluid along the channels 166. An opening (not shown), similar to the previously described openings, may be formed in each channel 166 adjacent the gauge region 165. Each opening leads to an internal passage that extends through the bit body 162 to an outlet 172. The outlet 172 advantageously communicates with the annulus between the drill string and the surrounding formation of the borehole when the drill bit is in use.

The drill bit of FIG. 10 may also include a portion 174 of the bit body 162 that is relieved. As illustrated, the relieved portion 174 includes four breaker slots 176 that are equally spaced about the circumference of the relieved portion 174. Each breaker slot 176 may be thought of as a flat-bottomed recess cut into the cylindrical outer surface of the portion 174. The breaker slots 176 facilitate tool engagement with the drill bit during attachment or detachment of the tapered threaded pin 178 into an internally threaded collar (not shown) at the lower end of a drill string. Furthermore, the breaker slots 176 are advantageously in register with one or more outlets 172 to facilitate the flow of drilling fluid as it emerges from the outlets 172 after passing through the internal passages of the drill bit. Specifically, this registration permits the size of the outlets 172 to be maximized to provide a greater flow potential.

Also, in the embodiment of FIG. 10, it should be noticed that gauge cutters 180 are disposed at the peripheral bearing surface 170 of the gauge region 165. The gauge cutters 180 may be mounted in recesses 182 in the bearing surface 170 so that the cutting edges of the gauge cutters 180 project only a short distance from the bearing surface 170. In the illustrated embodiment, two gauge cutters 180 are provided on each portion of the bearing surface 170 which lies at the outer end of a blade 164 on the leading face of the drill bit. Instead of, or in addition to, the gauge cutters 180, gauge protection inserts (not shown), similar to the inserts 136 discussed previously, may be disposed in the bearing surface 170.

Since the bearing surface 170 of the gauge region 165 extends continuously about the whole periphery of the drill bit, it is possible that occasional difficulty may be experienced when withdrawing the drill bit from the borehole. Accordingly, to facilitate withdrawal of the drill bit, a chamfer, such as a frusto-conical peripheral chamfer 184, may be formed in the upper edge of the gauge region 165. In addition, back-reaming cutters 186 may be mounted in a peripherally spaced apart relationship on the upper edge of the gauge region 165. Under particularly difficult conditions, the back-reaming cutters 186 may facilitate removal of the drill bit from the borehole by reaming out the walls of the borehole as the rotating drill bit is withdrawn. In this case, the combination of the back-reaming cutters 186 with the chamfer 184 may increase the exposure of the cutters 186 and, thus, increase their efficiency.

Figure 11:
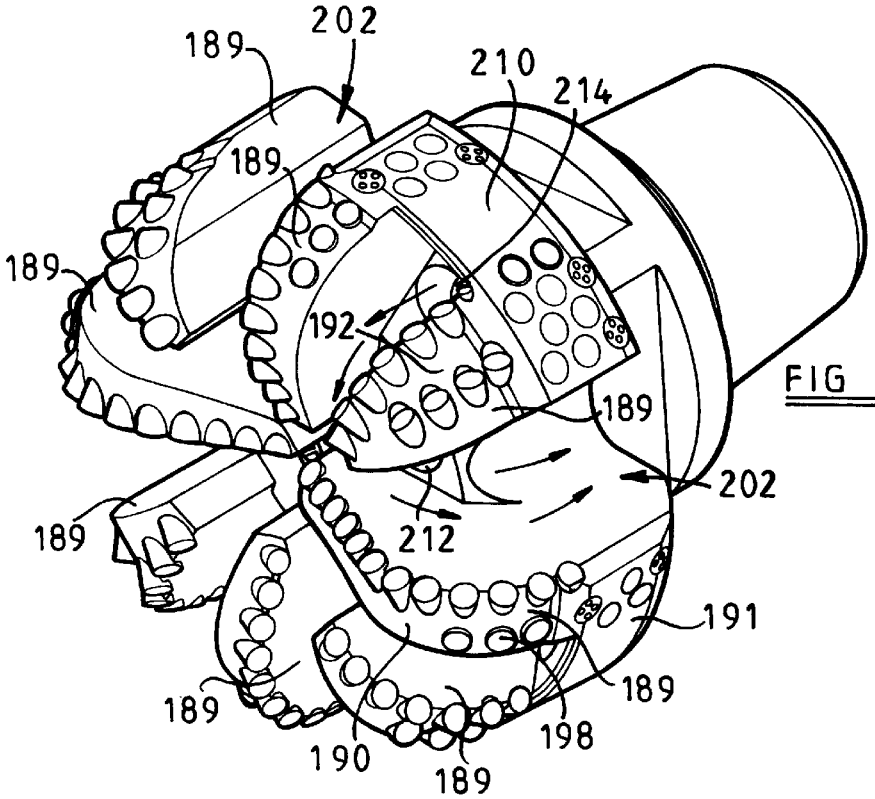
FIG. 11 is a perspective view of another embodiment of a drill bit in accordance with the invention.
Figure 12:
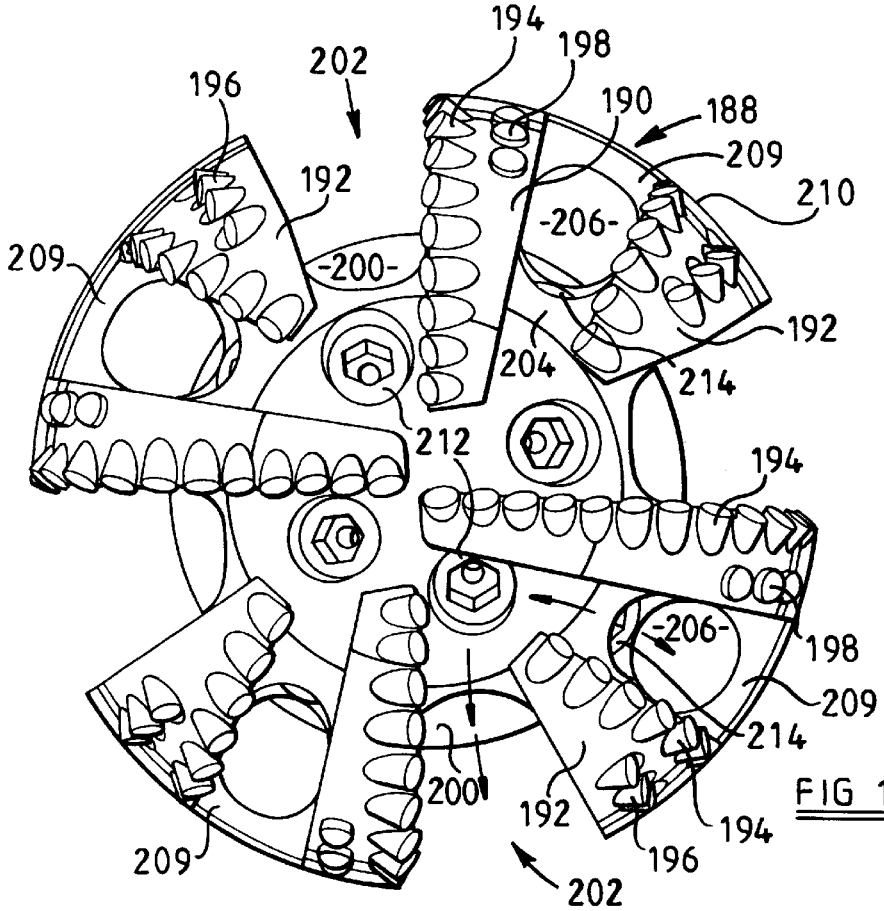
FIG. 12 is an end view of the drill bit shown in FIG. 11.

To this point, drill bits have been disclosed as having a passage disposed in only one channel where the gauge region includes a bearing surface extending across the outer end of that one channel, or as having a passage disposed in each channel where a bearing surface extends continuously around the entire periphery of the bit. However, many other arrangements may be possible. As one example, FIGS. 11 and 12 illustrate a drill bit having a passage disposed in a first plurality of channels which terminate with a bearing member in the gauge region, and where a second plurality of channels lead to a conventional junk slot. Specifically, channels leading to an internal passage and bearing member are alternated with channels leading to a conventional junk slot.

As illustrated in FIGS. 11 and 12, the drill bit includes a bit body 188. Eight blades 189 are formed on the leading face of the bit and extend generally outwardly from the axis of the bit towards the gauge region 191. The blades 189 include four longer blades 190 alternating with four shorter blades 192. A plurality of cutting structures 194 extend side-by-side along each of the blades 189. Back-up cutters 196 may be provided rearwardly of the primary cutting structures 194 on the shorter blades 192, whereas abrasion elements 198 may be disposed rearwardly of the primary cutting structures 194 on the longer blades 190.

A channel 200 is defined between the leading edge of each longer blade 190 and the trailing edge of the preceding shorter blade 192. Each channel 200 leads outwardly to a junk slot 202 which extends upwardly through the gauge region 191 to the annulus between the drill string and the borehole. Similarly, a channel 204 is defined between the leading edge of each shorter blade 192 and the trailing edge of the preceding longer blade 190. In this case, however, an opening 206 is formed in each channel 204 adjacent the gauge region 191. Each opening 206 leads to a passage 208 that passes internally through the bit body 188 to an outlet which passes fluid into the annulus between the drill string and the surrounding borehole. A bearing member 209 is formed outwardly of each opening 206 between the outer ends of the respective adjacent blades 190 and 192. Each bearing member 209 includes a substantially continuous peripheral bearing surface 210 at the gauge region 191. The bearing surfaces 210 may also incorporate any of the features previously described with reference to the bearing surfaces of FIGS. 1–10.

Inner nozzles 212 are mounted in the surface of the bit body 188 and are located fairly close to the central axis of the bit. The inner nozzles 212 are positioned to provide efficient cleaning in the central region of the bit. The inner nozzles 212 may also be directed to deliver drilling fluid outwardly along each channel 200 along the leading side of one of the four longer blades 190 to clean and cool the cutting elements 194 mounted on that blade.

An outer nozzle 214 is mounted in a socket in the wall of each internal passage 208 and is directed to cool and clean the outer cutters 194 on the adjacent shorter blade 192. Fluid from each outer nozzle 214 flows both upwardly through the internal passage 206 and also inwardly towards the adjacent inner nozzle 212 to cool and clean the inner cutters on the shorter blades 192. This inwardly directed fluid then becomes entrained with the fluid flowing outwardly from the adjacent inner nozzle 212 so that it flows outwardly through the rearwardly adjacent channel 200 leading to a junk slot 202. The flow of drilling fluid is illustrated by arrows in FIG. 12.

The provision of four continuous stretches of peripheral bearing surfaces 210 in this embodiment increases the bearing surface area and, thus, provides some or all of the advantages mentioned previously. At the same time, the provision of the internal passages alternating with junk slots, combined with the fluid flow described above, may enhance the clearing of cuttings from the face of the bit and may reduce the risk of balling up cuttings in the internal passages 206.

In the arrangement shown in FIGS. 11 and 12, the junk slots 202 extend substantially parallel to the longitudinal axis of the bit body 188. However, in an alternate arrangement, the junk slots may extend helically with respect to the longitudinal axis so that the upper extremity of the bearing surface 210 on one side of the junk slot 202 approaches or overlaps the circumferential position of the lower extremity of the bearing surface 210 on the other side of the junk slot. Such arrangement may then provide that there is a portion of the bearing surface 210 around substantially the whole 360 degree periphery of the gauge region 191.

While the invention may be susceptible to various modifications and alternative forms, specific embodiments have been shown by way of example in the drawings and have been described in detail herein. However, it should be understood that the invention is not intended to be limited to the particular forms disclosed. Rather, the invention is to cover all modifications, equivalents and alternatives falling within the spirit and scope of the invention as defined by the following appended claims.

What is claimed is:

1. A rotary drill bit for connection to a drill string and for drilling boreholes in subsurface formations comprising:

a bit body having a leading face and a gauge region;

a plurality of cutting elements disposed in the leading face of the bit body;

a plurality of fluid channels formed in the leading face of the bit body; and a plurality of nozzles mounted in the bit body for supplying drilling fluid to the channels for cleaning and cooling the cutting elements, wherein there is provided in at least one of said channels an opening into an enclosed passage which passes internally through the bit body to an outlet which, in use, communicates with the annulus between the drill string and the wall of the borehole being drilled, the gauge region of the drill bit comprising a bearing surface which extends around substantially the whole of the gauge region.

2. A drill bit according to claim 1, wherein said gauge region bearing surface is substantially continuous.

3. A drill bit according to claim 2, wherein the substantially continuous bearing surface of the gauge region extends across each of said channels, thereby to inhibit flow of drilling fluid from each channel across the gauge region of the drill bit.

4. A drill bit according to claim 1, wherein the leading face of the bit body is formed with a plurality of blades extending outwardly away from the axis of the bit towards the gauge region, said fluid channels being defined between said blades.

5. A drill bit according to claim 1 wherein there is provided in said enclosed passage a nozzle for supplying drilling fluid, said nozzle being at least partly directed towards said opening so as to deliver drilling fluid through said opening and into and inwardly along said one channel.

6. A drill bit according to claim 1, wherein there is provided in said passage a nozzle for supplying drilling fluid, said nozzle being at least partly directed towards said outlet from the passage, so as to deliver drilling fluid through said outlet to the annulus.

7. A drill bit according to claim 1, wherein there is provided in said passage a nozzle for supplying drilling fluid, said nozzle being mounted in a socket in a wall of said passage, the axis of the socket and of the nozzle being inclined with respect to the axis of the passage.

8. A drill bit according to claim 1, wherein each of said channels is provided with an opening into an enclosed passage which passes internally through the bit body to an outlet which, in use, communicates with the annulus between the drill string and the wall of the borehole being drilled.

9. A drill bit according to claim 8, wherein each enclosed passage passing internally through the bit body extends generally parallel to the longitudinal central axis of the drill bit.

10. A drill bit according to claim 1, further comprising:

a plurality of reaming cutters disposed on said gauge region and spaced apart from said leading face.

11. A drill bit according to claim 1, further comprising:

a peripheral chamfered edge formed in said gauge region and being spaced apart from said leading face.

12. A drill bit according to claim 11, further comprising:

a plurality of reaming cutters disposed on said chamfered edge.

13. A drill bit according to claim 1, further comprising:

a plurality of formation-engaging elements disposed on said bearing surface, a portion of said bearing surface disposed radially outwardly from said opening being free from said formation-engaging elements.

14. A drill bit according to claim 1, wherein said bit body comprises a shank having at least one relieved portion, said relieved portion being positioned adjacent said outlet.

15. A rotary drill bit for connection to a drill string and for drilling boreholes in subsurface formations comprising:

a bit body having a leading face and a gauge region;

a plurality of blades formed on the leading face of the bit and extending outwardly away from the axis of the bit towards the gauge region so as to define between the blades a plurality of fluid channels leading towards the gauge region;

a plurality of cutting elements mounted along each blade, and a plurality of nozzles mounted in the bit body for supplying drilling fluid to the channels for cleaning and cooling the cutting elements, wherein there is provided in at least one of said channels an opening into an enclosed passage which passes internally through the bit body to an outlet which, in use, communicates with the annulus between the drill string and the wall of the borehole being drilled, the gauge region of the drill bit comprising:

a substantially continuous bearing surface which extends around substantially the whole of the gauge region.

16. A drill bit according to claim 15, wherein each cutting element comprises a superhard table of polycrystalline diamond bonded to a substrate.

17. A drill bit according to claim 15, wherein each of said channels is provided with an opening into an enclosed passage which passes internally through the bit body to an outlet which, in use, communicates with the annulus between the drill string and the wall of the borehole being drilled.

18. A drill bit according to claim 15, further comprising:

a plurality of reaming cutters disposed on said gauge region and spaced apart from said leading face.

19. A drill bit according to claim 15, further comprising:

a peripheral chamfered edge formed in said gauge region and being spaced apart from said leading face.

20. A drill bit according to claim 19, further comprising:

a plurality of reaming cutters disposed on said chamfered edge.

21. A drill bit according to claim 15, further comprising:

a plurality of formation-engaging elements disposed on said bearing surface, a portion of said bearing surface disposed radially outwardly from said opening being free from said formation-engaging elements.

22. A drill bit according to claim 15, wherein said bit body comprises a shank having at least one relieved portion, said relieved portion being positioned adjacent said outlet.

23. A rotary drill bit for drilling a borehole, said drill bit comprising:

a bit body having a leading face and a peripheral gauge region;

a shank coupled to said bit body, said shank having at least one relieved portion;

an opening disposed in said leading face, said opening leading to a passage passing internally through said bit body between said opening and an outlet; and a bearing surface disposed at a portion of said gauge region radially outwardly from said opening.

24. The drill bit, as set forth in claim 23, further comprising:

a plurality of blades disposed on said leading face, said plurality of blades extending outwardly toward said gauge region and forming a plurality of fluid channels therebetween;

a plurality of cutting elements disposed on each of said plurality of blades; and at least one nozzle disposed in said bit body for supplying fluid to each of said fluid channels.

25. The drill bit, as set forth in claim 24, wherein said opening receives fluid supplied by said at least one nozzle.

26. The drill bit, as set forth in claim 24, wherein said opening is disposed in one of said plurality of fluid channels to receive fluid supplied by said at least one nozzle.

27. The drill bit, as set forth in claim 23, wherein said bearing surface inhibits fluid flow across said portion of said gauge region.

28. The drill bit, as set forth in claim 23, wherein said bearing surface bears against a wall of said borehole when in use.

29. The drill bit, as set forth in claim 23, wherein said bearing surface is substantially continuous along said gauge region.

30. The drill bit, as set forth in claim 23, wherein said shank comprises four relieved portions, resulting in said shank having a substantially rectangular portion.

31. The drill bit, as set forth in claim 30, wherein said bit body comprises a substantially rectangular portion with said substantially rectangular cross-section of said shank.

32. The drill bit, as set forth in claim 31, wherein said drill bit comprises a plurality of openings disposed in said leading face, each of said plurality of openings leading to a respective passage passing internally through said bit body between said respective opening and an outlet.

33. The drill bit, as set forth in claim 32, wherein at least one of said plurality of openings and respective passages is disposed in said leading face adjacent a respective relieved portion of said shank.

34. The drill bit, as set forth in claim 23, wherein said drill bit further comprises a plurality of cutters disposed on said bearing surface.

35. The drill bit, as set forth in claim 23, wherein said drill bit further comprises a plurality of abrasion resistant elements disposed intermittently on said bearing surface.

36. The drill bit, as set forth in claim 35, wherein said plurality of abrasion resistant elements comprise tungsten carbide elements.

37. The drill bit, as set forth in claim 23, further comprising:

i) a plurality of reaming cutters disposed on said gauge region and spaced apart from said leading face.

38. The drill bit, as set forth in claim 23, further comprising:

a peripheral chamfered edge formed in said gauge region and being spaced apart from said leading face.

39. The drill bit, as set forth in claim 38, further comprising:

a plurality of reaming cutters disposed on said chamfered edge.

40. A rotary drill bit for drilling a borehole, said drill bit comprising:

a bit body having a leading face and a peripheral gauge region;

a plurality of blades disposed on said leading face, said plurality of blades extending outwardly toward said gauge region and forming a plurality of fluid channels therebetween;

a plurality of cutting elements disposed on each of said plurality of blades;

a plurality of nozzles disposed in said bit body for supplying fluid to each of said fluid channels;

a substantially continuous bearing member disposed in axially spaced apart relation to said bit body; and a plurality of fluid passageways for receiving said fluid, each of said plurality of fluid passageways passing through an interior portion of said bearing member.

41. A rotary drill bit comprising:

a bit body having a leading face and a peripheral gauge region;

an opening disposed in said leading face, said opening leading to a passage passing internally through said bit body between said opening and an outlet;

a bearing surface disposed at a portion of said gauge region outwardly from said opening; and a plurality of reaming cutters disposed on said gauge region and spaced apart from said leading face.

42. A rotary drill bit comprising:

a bit body having a leading face and a peripheral gauge region;

an opening disposed in said leading face, said opening leading to a passage passing internally through said bit body between said opening and an outlet;

a bearing surface disposed at a portion of said gauge region outwardly from said opening; and a peripheral chamfered edge formed in said gauge region and being spaced apart from said leading face.

43. A rotary drill bit comprising:

a bit body having a leading face and a peripheral gauge region;

a plurality of blades disposed on said leading face, said plurality of blades extending outwardly toward said gauge region and forming a plurality of fluid channels therebetween;

an opening disposed in at least one of said plurality of fluid channels, said opening leading to a passage passing internally through said bit body between said opening and an outlet, said at least one of said plurality of fluid channels terminating in a bearing member disposed at a portion of said gauge region outwardly from said opening; and a junk slot terminating at least another of said plurality of fluid channels.

44. A rotary drill bit comprising:

a bit body having a leading face and a peripheral gauge region;

a plurality of cutting elements disposed on said leading face;

a first plurality of fluid channels formed in said leading face;

a second plurality of fluid channels formed in said leading face;

a respective opening disposed in each of said first plurality of fluid channels, each of said respective openings leading to a respective passage passing internally through said bit body;

a respective bearing member disposed at a portion of said gauge region outwardly from each of said respective openings; and a respective junk slot terminating each of said second plurality of fluid channels.

45. A rotary drill bit comprising:

a bit body having a leading face and a peripheral gauge region;

a plurality of cutting elements disposed on said leading face;

a plurality of fluid channels formed in said leading face;

a plurality of nozzles disposed in said bit body for supplying fluid to said plurality of channels;

a respective opening disposed in each circumferentially alternate fluid channel, each of said respective openings leading to a respective passage passing internally through said bit body;

a respective bearing member disposed at a portion of said gauge region outwardly from each of said respective openings; and a respective junk slot terminating each fluid channel having no said opening.

46. A method of steering a drill bit within a borehole, said method comprising the steps of:

(a) rotating a drill bit within said borehole, said drill bit having a peripheral gauge region and having a substantially continuous bearing surface disposed about said peripheral gauge region; and (b) applying force to said substantially continuous bearing surface to cause said drill bit to change direction of drilling said borehole.

47. A rotary drill bit for connection to a drill string and for drilling boreholes in subsurface formations comprising:

a bit body having a leading face and a gauge region;

a plurality of cutting elements disposed in the leading face of the bit body;

a plurality of fluid channels formed in the leading face of the bit body; and a plurality of nozzles mounted in the body for supplying a drilling fluid to the plurality of fluid channels for cleaning and cooling the cutting elements;

wherein at least one channel of the plurality of fluid channels is provided with an opening into an enclosed passage which passes internally through the bit body to an outlet which, in use, communicates with the annulus between the drill string and the wall of the borehole being drilled, the gauge region of the drill bit comprising a bearing surface which extends around substantially the whole of the gauge region;

at least one nozzle of the plurality of nozzles is so located on the bit body as to deliver to said one channel, a supply of drilling fluid which flows outwardly along said one channel towards the gauge region.

48. A drill bit according to claim 47, wherein said one nozzle is located in said one channel.

49. A drill bit according to claim 48, wherein said one channel has an inner end and an outer end and wherein said one nozzle is located adjacent the inner end of said one channel.

50. A drill bit according to claim 47, wherein said one channel is in communication with another channel defined between blades on the bit body, and wherein a further nozzle for supplying drilling fluid is so located on the bit body as to deliver to said other channel a supply of drilling fluid which flows first inwardly and along said other channel and then outwardly along said one channel towards said opening.

51. A drill bit according to claim 50, wherein said one channel has an inner end and an outer end and wherein said flurther nozzle is located adjacent the outer end of said other channel.

* * * * *